US006634392B2

(12) United States Patent
Breen

(10) Patent No.: US 6,634,392 B2
(45) Date of Patent: Oct. 21, 2003

(54) PIN STRAIGHTENING TOOL

(75) Inventor: Robert Dennis Breen, Groton, MA (US)

(73) Assignee: Raytheon Company, Lexington, MA (US)

( * ) Notice: Subject to any disclaimer, the term of this patent is extended or adjusted under 35 U.S.C. 154(b) by 34 days.

(21) Appl. No.: 10/021,529

(22) Filed: Dec. 12, 2001

(65) Prior Publication Data

US 2003/0106604 A1 Jun. 12, 2003

(51) Int. Cl.[7] ..... B21F 1/02
(52) U.S. Cl. ..... 140/147; 72/479
(58) Field of Search ..... 140/147; 72/457, 72/458, 479

(56) References Cited

U.S. PATENT DOCUMENTS 3,903,937 A * 9/1975 Drummond ..... 140/147
4,559,978 A * 12/1985 Glatzel ..... 140/147

* cited by examiner

*Primary Examiner*—Lowell A. Larson
(74) *Attorney, Agent, or Firm*—Iandiorio & Teska

(57) ABSTRACT

A pin straightening tool including a shaft terminating in an end assembly, a chamber in the end assembly for receiving a bent pin therein, the chamber terminating in a shelf inside the end assembly, and a bore located in the chamber for straightening the bent pin as the shaft is rotated urging the distal end of the bent pin into the bore.

39 Claims, 3 Drawing Sheets

PIN STRAIGHTENING TOOL

FIELD OF THE INVENTION

This invention relates to a pin straightening tool useful for straightening bent connector pins and also useful for insuring that all the connector pins of an electronic module are straight and concentrically located with respect to the connector receptacle.

BACKGROUND OF THE INVENTION

Certain connectors including the General Purpose Output (GPO) connector have a very small (e.g., 0.012 inches) diameter center conductor pin which is susceptible to bending inside the GPO receptacle. Since the receptacle surrounds the pin, and since many GPO connectors may be present in a given electronic module, it can be difficult to detect when a connector pin is bent and/or when it is not concentrically located within the receptacle.

The other portion of the connector, typically referred to as a plug, then receives the pin as the plug forced into the receptacle. If the pin is bent, however, the action of forcing the plug into the receptacle can further bend the pin resulting in an incomplete connection or, worse, pin breakage which can lead to scrapping the often expensive electronic module.

Even if the pin is bent but not broken, however, testing or operation of the electronic module will result in a failure requiring expensive and time consuming trouble shooting, re-work, and finally, once the failure mode is determined, repair of the bent pin.

Currently, small tweezers are used to straighten the pin but this practice is difficult to master resulting in a time consuming trial and error process which does not always ensure that the pin is both straight and also that it is concentrically located in the connector receptacle. Another prior art device includes a shaft with a single bore which receives the pin therein. Unfortunately, this device cannot be effectively used if the pin is severely bent, and, even if the pin is only slightly bent, this tool does not always result in a straight pin or, worse, can result in a broken pin in which case, as stated above, the electronic module may have to be scrapped. Moreover, this prior art tool is also somewhat difficult to use.

SUMMARY OF THE INVENTION

It is therefore an object of this invention to provide a more useful and precise pin straightening tool.

It is a further object of this invention to provide such a pin straightening tool which can be used with GPO connectors and also with other types of connectors having pins.

It is a further object of this invention to provide such a pin straightening tool which can be used to straighten bent connector pins and which can also be used to ensure that all the connector pins of an electronic module are straight and concentrically located in the connector receptacle before the plugs are placed therein.

It is a further object of this invention to provide such a pin straightening tool which allows the operator to gently straighten even severely bent connector pins without breaking them.

It is a further object of this invention to provide such a pin straightening tool which is simple to use.

It is a further object of this invention to provide such a pin straightening tool which easy to manufacture.

It is a further object of this invention to provide such a pin straightening tool which is cost effective to manufacture.

It is a further object of this invention to provide such a pin straightening tool which prevents scrapping of expensive electronic modules.

It is a further object of this invention to provide such a pin straightening tool which eliminates the expense involved with time consuming trouble shooting, re-work, and analysis of electronic modules with bent and/or non-concentrically located pins.

It is a further object of this invention to provide such a pin straightening tool which, if used correctly, ensures that the connector pins are straight and provides feedback to the user when a bent pin is properly straightened and concentrically located in its receptacle.

The invention results from the realization that a more precise and easier to use pin straightening tool is effected by a) a shaft terminating in an end assembly with an outer diameter slightly less than the inner diameter of the receptacle housing the pin and fashioned with an inner cam shaped wall or collar which surrounds the connector pin and which straightens and also concentrically aligns the pin in the receptacle as the shaft is rotated, and b) a bore adjacent the cam shaped wall or collar into which the pin is received and straightened when the pin is concentrically aligned thus providing a positive feedback to the operator that the pin is now straight.

This invention features a pin straightening tool comprising a shaft terminating in an end assembly and a chamber in the end assembly for receiving a bent pin therein. The chamber terminates in a shelf inside the end assembly and there is a bore located in the chamber for straightening the bent pin as the shaft is rotated urging the distal end of the bent pin into the bore.

In a preferred embodiment, the bore is located in the center of the end assembly and the chamber is located eccentrically with respect to the center of the end assembly. Also in the preferred embodiment, the chamber includes a gap therein forming two opposing longitudinally extending edges which can be driven behind the bent pin. The bore typically has a rearward side abutting a rearward edge of the shelf.

In one example, the bore has a diameter slightly greater than the diameter of the pin, the chamber has a diameter much larger than the diameter of the bore, the chamber has a depth less than the length of the pin, and the depth of the bore when added to the depth of the chamber totals a length greater than the length of the pin.

In the preferred embodiment, the end assembly includes a first reduced diameter portion receivable in the receptacle containing the pin therein. The first reduced diameter portion has an outside diameter less than the inside diameter of the receptacle and the chamber is located in the first reduced diameter portion. Preferably, the end assembly further includes a second reduced diameter portion also receivable in the receptacle containing the pin. The outside diameter of the second reduced diameter portion is slightly less than the inside diameter of the receptacle. In this embodiment, the bore extends into second reduced diameter portion.

The second reduced diameter portion preferably has a length less than the depth of the receptacle, and the second reduced diameter portion defines a shoulder on the end assembly larger in diameter than the receptacle. There may also be a sloping wall between the first reduced diameter portion and the second reduced diameter portion for aligning the second reduced diameter portion in the receptacle. In one example, the shaft includes a knurled finish for gripping thereof, the shaft is round, and the end assembly is round.

One pin straightening tool in accordance with this invention includes a shaft terminating in an end assembly receivable in a receptacle containing a bent pin, a cam surface inside the end assembly configured to urge the distal end of the bent pin into a straight configuration, and a bore which receives the distal end of the bent pin therein when it is urged into the straight configuration by the cam surface. Typically, the cam surface is the interior wall of a chamber formed in the end assembly. This chamber may terminate in a shelf inside the end assembly. Preferably, the bore is located in the center of the end assembly and the chamber is located eccentrically with respect to the center of the end assembly. In addition, the chamber may include a gap therein forming two opposing longitudinally extending edges which can be driven behind a bent pin.

The pin straightening tool of this invention may include a shaft terminating in an end assembly having a first distally located reduced diameter portion and a second larger reduced diameter portion adjacent the first reduced diameter portion, a chamber in the first reduced diameter portion terminating in a shelf, the chamber having a gap therein forming two opposing longitudinally extending edges which can be driven behind a bent over pin, and a bore located in the shelf and extending into the second reduced diameter portion for straightening the bent pin as the shaft is rotated forcing the distal end of the bent pin into the bore.

A pin straightening tool in accordance with a preferred embodiment of this invention comprises a shaft terminating in an end assembly, a chamber in the end assembly terminating in a shelf therein, the chamber having an interior wall defining a cam surface terminating in a gap forming two opposing longitudinally extending edges receivable in a receptacle containing a bent pin therein, and a bore abutting the interior wall of the chamber for receiving the bent pin therein as the tool is rotated, as one longitudinally extending edge moves behind the bent pin, and the cam surface urges the bent pin into the bore.

In one example, there is a shaft, a collar portion on a distal end of the shaft which urges the pin into a concentric relationship inside the receptacle, and a bore which receives the distal end of the pin therein as the collar portion is rotated. Typically, the collar portion is defined by a reduced diameter distal end of the shaft, and an opening in the reduced diameter distal end of the shaft in communication with the chamber.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
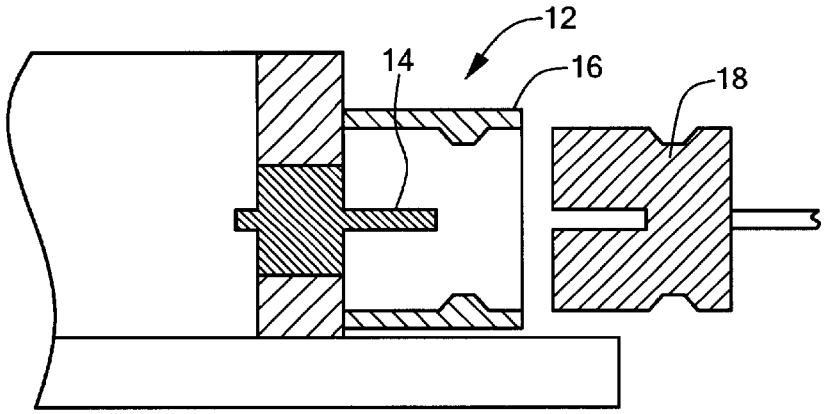
FIG. 1 is a schematic cross sectional view of a typical connector assembly including a receptacle with a center conductor or pin.

FIG. 1 shows a typical connector 12 which may be a GPO connector including center conductor or pin 14 inside receptacle 16. Pin 14, in one example, is only 0.012 inches in diameter. Bore 20 of plug 18 receives pin 14 therein when plug 18 is forced into receptacle 16.

Figure 2:
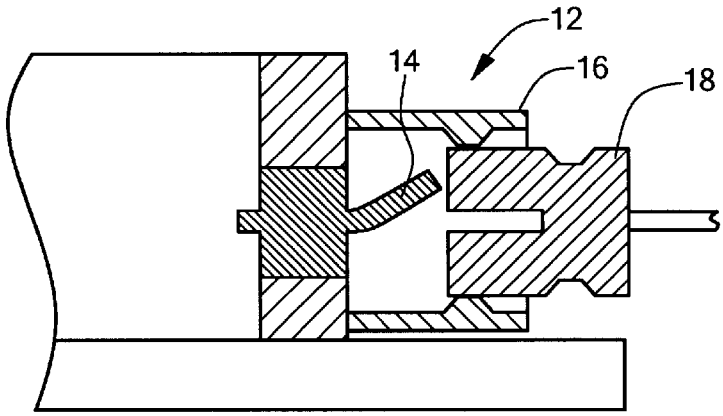
FIG. 2 is another schematic cross sectional view similar to FIG. 1 except now the center conductor or pin is bent.

As delineated in the Background section above, however, pin 14, FIG. 2 is susceptible to bending and the action of forcing plug 18 into receptacle 16 can further bend pin 14 resulting in an incomplete connection or, worse, breakage of pin 14 which can lead to scrapping of the often expensive electronic module including connector 12 and, typically, numerous additional similar connectors.

Figure 3:
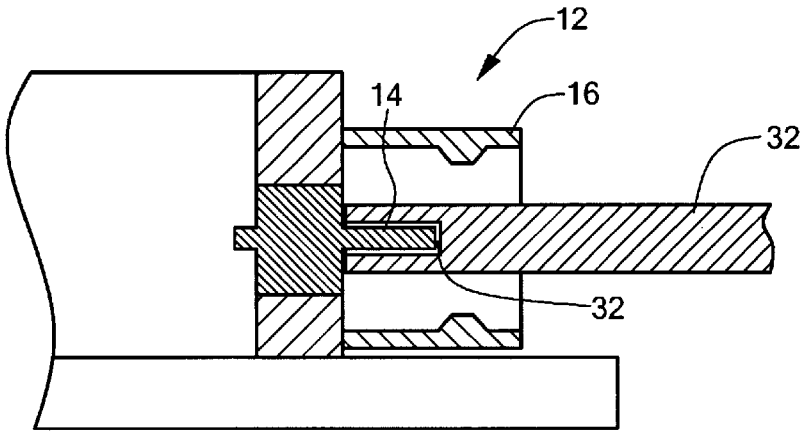
FIG. 3 PRIOR ART
FIG. 3 is a schematic cross sectional view showing a prior art pin straightening tool engaged over a pin inside a connector receptacle.

In the prior art, tweezers or even tool 30, FIG. 3 which includes single bore 32 in the distal end thereof have been used in an attempt to straighten bent pins. Unfortunately, tool 30 cannot be effectively used if pin 14 is severely bent and, even if pin 14 is only slightly bent, tool 30 does not always result in a straight pin or worse, can result in a broken pin in which case the electronic module may have to be scrapped resulting in an unfortunate waste. The other problems associated with tweezers and prior art tool 30 are delineated in the Background section above.

Figure 4:
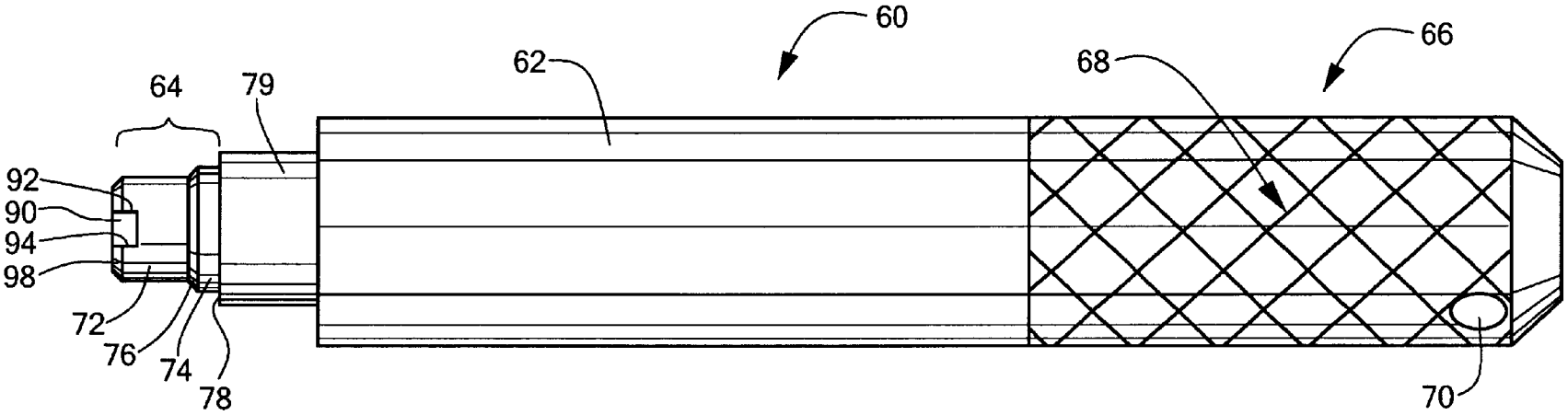
FIG. 4 is a schematic side view showing the preferred embodiment of the pin straightening tool of the subject invention.

Pin or center conductor straightening tool 60, FIG. 4 of this invention includes typically round shaft 62 terminating in unique end assembly 64. Handle end 66 may include knurled surface 68. Orifice 70 may also be included through handle end 66 and used for tethering tool 60 to a workbench where electronic components with center pin connectors are being assembled or tested. A prototype tool 60 was made of metal, was 1.5 inches long and handle end 66 was 0.250 inches in diameter.

In this same example, end assembly 64 includes first reduced diameter portion 72 which is 0.113 inches in diameter and 0.067 inches in length with a 0.010 chamfer. Second reduced diameter portion 74 is 0.137 inches in diameter and 0.023 inches long with a 0.010 chamfer. Sloping wall 76 joins first reduced diameter portion 72 with second reduced diameter portion 74. Shoulder 78 is present between second reduced diameter portion 74 and third reduced diameter portion 79 and acts as a positive stop since third reduced diameter portion 79 is too large (e.g., 0.166 inches in diameter) to be received inside the connector receptacle. These dimensions are specifically tailored, in this example, for a GPO connector 0.140 inches inside diameter and 0.163 inches deep with a pin 0.055 inches long and 0.012 inches in diameter. Those skilled in the art, however, will understand how to tailor these specific dimensions for connectors of other configurations and dimensions.

Sloping wall 76 assists in guiding second reduced diameter portion 74 into the connector receptacle to a maximum depth defined by shoulder 78. Thus, in this specific example, and also in a preferred embodiment, only first and second reduced diameter portions 72 and 74 are receivable in the receptacle containing the pin to be checked for concentricity and/or to be straightened and second reduced diameter portion 74 has a diameter slightly less than the inside diameter of the receptacle while first reduced diameter portion 72 has even a smaller diameter.

Also in the preferred embodiment, the total length of end assembly 64 is approximately equal to, or slightly less than the depth of the receptacle. In the above example, the length of end assembly 64 is 0.110 inches which is the sum of the length of first reduced diameter portion 72 (0.077 inches) and the length of second reduced diameter portion 74 (0.033 inches).

Figure 5:
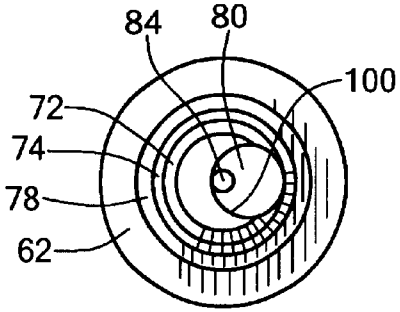
FIG. 5 is a schematic top view of the end assembly portion of the preferred embodiment of the pin straightening tool of the subject invention.
Figure 6:
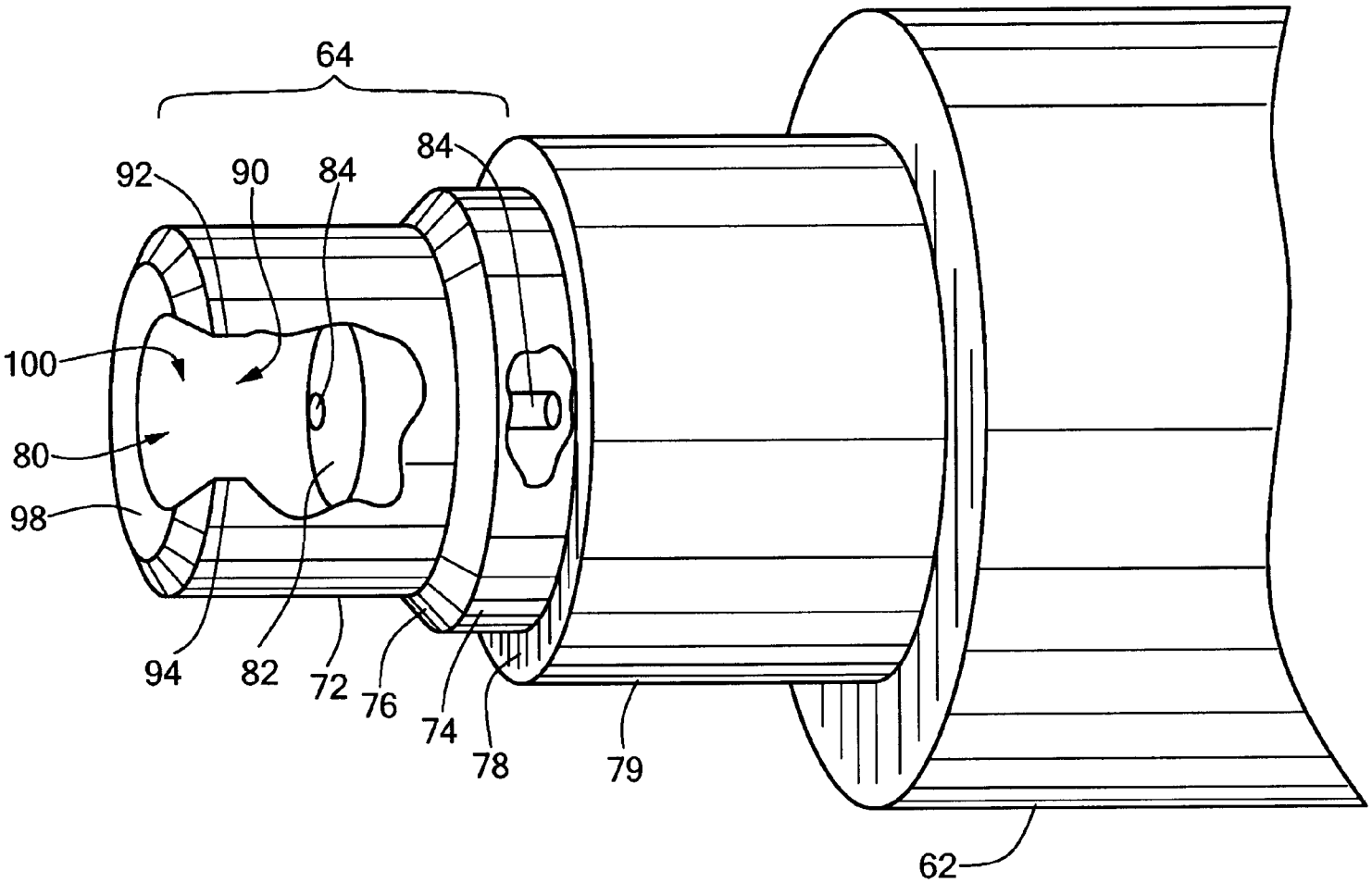
FIG. 6 is a schematic partially cut away view of the end assembly of the preferred embodiment of the pin straightening tool of the subject invention.

As better shown in FIGS. 5 and 6, chamber 80 is located in first reduced diameter portion 72 of end assembly 64 and terminates in shelf 82, FIG. 6. Pin straightening bore 84 is preferably located in chamber 80 and begins at shelf 82 and extends into second reduced diameter portion 74.

In the preferred embodiment, bore 84 is located in the center of end assembly 64 but the center of round chamber 80 is located eccentrically with respect to the center of end assembly 64. In other words, the longitudinal axis of bore 84 is disposed along the longitudinal axis of the tool. The longitudinal axis of round chamber 80, however, is parallel to but displaced from the longitudinal axis of the tool. Chamber 80, in the example started above, is 0.025 inches deep while bore 84 is 0.06 inches deep, and chamber 80 is 0.067 inches in diameter while bore 84 is 0.018 inches in diameter—slightly greater in diameter then the diameter of a 0.012 inch diameter pin.

In general then, chamber 80 has a depth less than the length of the pin to be straightened and the depth of bore 84, when added to the depth of chamber 80, totals a length slightly greater than the length of the pin to be straightened.

Preferably, chamber 80 has or defines a gap 90, FIGS. 4 and 6 in the outer wall of first reduced diameter portion 72 forming two opposing longitudinally extending knife edges 92 and 94 which can be driven behind even the most severely bent pin as first reduced diameter portion 72 is placed within the connector receptacle and tool 60 is rotated to the right or to the left. The top surface 98 of chamber 80, which is defined by the distal end of first reduced diameter portion 72, preferably has a chamfer 0.010×45°.

As shown above, bore 84, FIG. 6 has a rearward side directly abutting the rearward edge of shelf 82 and aligned with the center of cam shaped chamber wall 100. Chamber 80, being off axis from the longitudinal axis of the tool, not only forms gap 90, it also defines cam shaped interior wall 100. It is this collar portion defined by gap edges 92 and 94 and interior cam surface 100 which urges a bent pin into a concentric relationship inside its receptacle and then into bore 84 for straightening as tool 60 is rotated. This action, as the now concentrically aligned pin falls into bore 84, allows reduced diameter portion 74 to be fully received within the connector receptacle up to where shelf 82 forms a stop thus providing direct feedback to the user that the center conductor pin is now both straight and concentrically aligned within the connector receptacle.

When used for quality assurance purposes, even if the pin is already straight and concentrically aligned, the action of the pin falling immediately into bore 84 and end assembly 64 being fully received within the connector receptacle up to shoulder 78 provides positive feedback to inspection or quality assurance personnel that the pin has not been bent or otherwise moved out of a concentric alignment with respect to the connector receptacle.

Thus, tool 60 is designed to be used prior to the insertion of plug 18, FIG. 2 so that pin 14 is assured to be straight and concentric. Tool 60, FIGS. 4–6 is inserted into the connector with a slight twisting motion. The twisting motion avoids bending an already bent pin any further since the user can feel any resistance a bent pin generates on shelf 82, FIG. 6. By twisting the tool during insertion, the straightening portion of the tool is allowed to slip past the bent pin. Once fully inserted, the tool is rotated one complete revolution. Tool 60 is designed to closely fit within the connector receptacle or shell and has a sharp knife-edge eccentric feature as disclosed above that straightens the pin during rotation. As the tool is rotated, the eccentric portion is driven behind the pin and gently pushes it back to the exact center. Tool 60 has been demonstrated to be effective even if the pin is bent so far as to be touching the inside of the connector receptacle.

Tool 60 may be made of a steel rod, one end of which is machined to a diameter that is very close to the inside diameter of a GPO or other connector. The length of this turned down end preferably exactly matches the inside depth of the GPO connector or any other similar type connector. In this way, the tool has a stop which provides a visual indication that the tool is fully inserted into the connector. In the exact center of the steel rod, bore 84 is drilled which is slightly larger than the connector pin diameter. This bore is deeper than the length of the pin to provide clearance after insertion. A chamber is also machined into this end, not as deep as the bore and eccentric to the longitudinal axis of the steel rod. The diameter and location of the chamber is such that the inner or back edge of the bore exactly lines up with the back edge of the chamber. The diameter of the chamber breaks out of the reduced diameter section creating two sharp knife-edges. In use, the operator inserts end assembly 64, FIG. 6 into the connector mindful of any resistance which would indicate contact with a bent pin against shelf 82. A twisting motion during insertion realigns the bent pin so that the gap 90 created by chamber 80 can slide down over the bent pin. After the tool has been inserted, the tool is gently rotated between the operator's fingers. One of the two sharp knife edges 94, 92 is then driven behind the bent pin and the pin is gently driven to the center of the cam wall 100 as the tool is rotated. Once the pin is thus centered, it falls into bore 84 and thereafter the tool can be removed from the connector receptacle.

Thus, in use, reduced diameter portion 72 is slowly inserted within receptacle 16, FIG. 2 until the resistance asserted by bent pin 14 is felt. Next, tool 60, FIGS. 4–6 is rotated and bent pin 14 is forced by knife edge 92 or 94 to travel about interior cam wall 100 whereupon it straightens into a concentric relationship within the receptacle as the tool turns. Once the pin reaches the center of wall 100, it will then be received in bore 84 whereupon reduced diameter section 74 is now fully received in the receptacle and the tool can be rotated further to ensure that the pin is straightened and concentrically located within the receptacle.

Thus, pin straightening tool 60, FIG. 4 includes shaft 62 terminating in an end assembly 64. Chamber 80, FIG. 6 is located in the end assembly for receiving a bent pin therein. Chamber 80 terminates in shelf 82 inside end assembly 64. Bore 84 is located in chamber 80 for straightening the bent pin as the shaft is rotated forcing the distal end of the bent pin into bore 84. Cam surface 100 is configured to urge the distal end of the bent pin into a straight configuration. Preferably, a collar portion defined by reduced diameter portion 72, chamber 80, and, edges 92 and 94 on each side of opening 90 in reduced diameter portion 72 urges a bent pin into a concentric relationship inside its receptacle.

Pin straightening tool 60, FIGS. 4–6 can be used with GPO connectors and also with other types of connectors having pins to straighten bent connector pins and also to ensure that all the connector pins of an electronic module are straight and concentrically located in the connector receptacle before the plugs are placed therein. Pin straightening tool 60 allows the operator to gently straighten even severely bent connector pins without breaking them. Pin straightening tool 60 is easy and cost effective to manufacture and prevents scrapping of expensive electronic modules. Also, the expense involved with time consuming trouble shooting, re-work, and analysis of electronic modules with bent and/or non-concentrically located pins is eliminated.

Precise and easy to use pin straightening tool 60 is effected by shaft 62 terminating in end assembly 64 receivable in the connector receptacle and configured with a cam shaped wall 100 or collar which surrounds the connector pin and which straightens and also concentrically aligns the pin in the receptacle as shaft 62 is rotated. Bore 84 adjacent cam shaped wall 100 receives the pin to straighten it when the pin is concentrically aligned.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, the embodiments and examples disclosed in the subject application are not to be taken as the only possible embodiments or examples. Other embodiments will occur to those skilled in the art and are within the following claims:

What is claimed is:

1. A pin straightening tool comprising:

a shaft terminating in an end assembly;

a chamber in the end assembly for receiving a bent pin therein, the chamber terminating in a shelf inside the end assembly; and a bore located in the chamber for straightening the bent pin as the shaft is rotated urging the distal end of the bent pin into the bore.

2. The pin straightening tool of claim 1 in which the bore is located in the center of the end assembly.

3. The pin straightening tool of claim 2 in which the chamber is located eccentrically with respect to the center of the end assembly.

4. The pin straightening tool of claim 3 in which the chamber includes a gap therein forming two opposing longitudinally extending edges which can be driven behind the bent pin.

5. The pin straightening tool of claim 3 in which the bore has a rearward side abutting a rearward edge of the shelf.

6. The pin straightening tool of claim 1 in which the bore has a diameter slightly greater than the diameter of the pin.

7. The pin straightening tool of claim 1 in which the chamber has a diameter at much larger than the diameter of the bore.

8. The pin straightening tool of claim 1 in which the chamber has a depth less than the length of the pin.

9. The pin straightening tool of claim 8 in which the depth of the bore when added to the depth of the chamber totals a length greater than the length of the pin.

10. The pin straightening tool of claim 1 in which the end assembly includes a first reduced diameter portion receivable in the receptical containing the pin therein.

11. The pin straightening tool of claim 10 in which the first reduced diameter portion has an outside diameter less than the inside diameter of the receptical.

12. The pin straightening tool of claim 10 in which the chamber is located in the first reduced diameter portion.

13. The pin straightening tool of claim 10 in which the end assembly further includes a second reduced diameter portion also receivable in the receptical containing the pin.

14. The pin straightening tool of claim 13 in which the second reduced diameter portion has an outside diameter slightly less than the inside diameter of the receptical.

15. The pin straightening tool of claim 13 in which the bore extends into the second reduced diameter portion.

16. The pin straightening tool of claim 13 in which the second reduced diameter portion has a length less than the depth of the receptical.

17. The pin straightening tool of claim 13 in which the second reduced diameter portion defines a shoulder on the end assembly larger in diameter than the receptical.

18. The pin straightening tool of claim 13 further including a sloping wall between the first reduced diameter portion and the second reduced diameter portion for aligning the second reduced diameter portion in the receptical.

19. The pin straightening tool of claim 1 in which the shaft includes a knurled finish for gripping thereof.

20. The pin straightening tool of claim 1 in which the shaft is round.

21. The pin straightening tool of claim 1 in which the end assembly is round.

22. A pin straightening tool comprising:

a shaft terminating in an end assembly receivable in a receptical containing a bent pin;

a cam surface inside the end assembly configured to urge the distal end of the bent pin into a straight configuration; and a bore which receives the distal end of the pin therein when it is urged into the straight configuration by the cam surface.

23. The pin straightening tool of claim 22 in which the cam surface is the interior wall of a chamber formed in the end assembly.

24. The pin straightening tool of claim 23 in which the chamber terminates in a shelf inside the end assembly.

25. The pin straightening tool of claim 24 in which the bore has a rearward side abutting a rearward edge of the shelf.

26. The pin straightening tool of claim 23 in which the chamber is located eccentrically with respect to the center of the end assembly.

27. The pin straightening tool of claim 23 in which the chamber includes a gap therein forming two opposing longitudinally extending edges which can be driven behind a bent pin.

28. The pin straightening tool of claim 23 in which the chamber has a diameter larger than the diameter of the bore.

29. The pin straightening tool of claim 23 in which the chamber has a depth less than the length of the pin.

30. The pin straightening tool of claim 23 in which the depth of the bore when added to the depth of the chamber totals a length greater than the length of the pin.

31. The pin straightening tool of claim 22 in which the bore is located in the center of the end assembly.

32. The pin straightening tool of claim 22 in which the bore has a diameter slightly greater than the diameter of the pin.

33. The pin straightening tool of claim 22 in which the end assembly includes a first reduced diameter portion receivable in the receptical containing the pin therein.

34. The pin straightening tool of claim 33 in which the end assembly further includes a second reduced diameter portion also receivable in the receptical containing the pin.

35. The pin straightening tool of claim 34 in which the second reduced diameter portion defines a shoulder on the end assembly larger in diameter than the receptacle.

36. The pin straightening tool of claim 34 further including a sloping wall between the first reduced diameter portion and the second reduced diameter portion for aligning the second reduced diameter portion in the receptical.

37. A pin straightening tool comprising:

a shaft terminating in an end assembly having a first distally located reduced diameter portion and a second larger reduced diameter portion adjacent the first reduced diameter portion;

a chamber in the first reduced diameter portion terminating in a shelf, the chamber having a gap therein forming two opposing longitudinally extending edges which can be driven behind a bent over pin; and a bore located in the shelf and extending into the second reduced diameter portion for straightening the bent pin as the shaft is rotated forcing the distal end of the bent pin into the bore.

38. A pin straightening tool comprising:

a shaft terminating in an end assembly;

a chamber in the end assembly terminating in a shelf therein, the chamber having an interior wall defining a cam surface terminating in a gap forming two opposing longitudinally extending edges receivable in a receptical containing a bent pin therein; and a bore abutting the interior wall of the chamber for receiving the bent pin therein as the tool is rotated, as one longitudinally extending edge moves behind the bent pin, and the cam surface urges the bent pin into the bore.

39. A pin straightening tool comprising:

a shaft;

a collar portion on a distal end of the shaft which urges the pin into a concentric relationship inside the receptical, said collar portion defined by a reduced diameter distal end of the shaft, a chamber eccentrically located in the reduced diameter distal end, and an opening in the reduced diameter distal end of the shaft in communication with the chamber; and a bore which receives the distal end of the pin therein as the collar portion is rotated.

* * * * *